US010736431B2

(12) United States Patent
Chung

(10) Patent No.: US 10,736,431 B2
(45) Date of Patent: Aug. 11, 2020

(54) MODULAR BED

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 313 days.

(21) Appl. No.: 15/990,104

(22) Filed: May 25, 2018

(65) Prior Publication Data

US 2019/0231078 A1 Aug. 1, 2019

(30) Foreign Application Priority Data

Feb. 1, 2018 (TW) ..... 107201605 U

(51) Int. Cl.

| | |
|---|---|
| ***A47C 17/16*** | (2006.01) |
| ***A47C 19/02*** | (2006.01) |
| ***A47C 23/18*** | (2006.01) |
| ***A47C 20/04*** | (2006.01) |
| ***A61G 7/015*** | (2006.01) |
| ***A61G 7/002*** | (2006.01) |

(52) U.S. Cl.

CPC ..... *A47C 17/161* (2013.01); *A47C 19/025* (2013.01); *A47C 20/041* (2013.01); *A47C 23/18* (2013.01); *A61G 7/002* (2013.01); *A61G 7/015* (2013.01)

(58) Field of Classification Search

CPC ..... A47C 17/161; A47C 23/18; A47C 20/041; A47C 19/025; A61G 7/002; A61G 7/015; A61G 7/05; A61G 7/051; A61G 7/0514

USPC ..... 5/619, 616

See application file for complete search history.

(56) References Cited

U.S. PATENT DOCUMENTS

| | | | | | |
|---|---|---|---|---|---|
| 29,038 | A | * | 7/1860 | Keene | A61G 7/05 5/600 |
| 131,488 | A | * | 9/1872 | Wilkes | A61G 7/015 5/617 |
| 137,596 | A | * | 4/1873 | Clinton | A61G 7/015 5/619 |
| 185,779 | A | * | 12/1876 | Praul | A47C 23/02 5/242 |
| 238,799 | A | * | 3/1881 | Morgan | A61G 7/015 5/619 |
| 336,110 | A | * | 2/1886 | Hemingway | A47C 19/122 5/111 |
| 438,146 | A | * | 10/1890 | Doherty | A61G 7/015 5/618 |

(Continued)

*Primary Examiner* — Nicholas F Polito
*Assistant Examiner* — Luke Hall
(74) *Attorney, Agent, or Firm* — Schwegman Lundberg & Woessner, P.A.

(57) ABSTRACT

A modular bed includes a base frame unit and a plurality of support frame units. Each of the support frame units includes a leading bar, a trailing bar, four mounting frames, four biasing members, a left linkage, and a right linkage. In response to loading or unloading of a retaining member of each of the left and right linkages, a respective one of the biasing members abuts against a top abutment wall or a bottom abutment wall of a respective one of the mounting frames so as to generate a counteracting force to counteract the loading or unloading movement of the retaining member, thereby providing a cushioning effect for the retaining member.

6 Claims, 16 Drawing Sheets

(56) References Cited

U.S. PATENT DOCUMENTS 439,088 A * 10/1890 Glidden ..... A47C 7/024 297/188.12
542,060 A * 7/1895 Lentz ..... A61B 50/10 312/209
598,454 A * 2/1898 Weaver, Jr. ..... A47C 19/025 5/305
629,275 A * 7/1899 Scribner ..... A61G 7/015 5/612
861,868 A * 7/1907 Lewis ..... A61G 7/015 5/613
909,244 A * 1/1909 Smith ..... A47C 23/18 5/190
1,775,547 A * 9/1930 Bayer ..... A61G 7/015 5/618
2,337,395 A * 12/1943 Leland, Jr. ..... A61G 7/015 5/610
2,394,352 A * 2/1946 Zatzkin ..... A47C 19/025 5/205
2,500,743 A * 3/1950 Beem ..... A61G 7/02 5/604
2,522,018 A * 9/1950 Blackman ..... A61G 7/015 5/607
2,547,827 A * 4/1951 Logan ..... A61G 7/015 5/612
2,595,321 A * 5/1952 Anderson ..... A47C 23/062 5/238
2,702,583 A * 2/1955 Feldman ..... A47C 17/161 297/112
3,081,463 A * 3/1963 Williams ..... A61G 7/002 5/616
3,107,940 A * 10/1963 Brooks ..... A47C 17/161 297/63
3,116,495 A * 1/1964 Gross ..... A47C 19/025 5/207
3,129,441 A * 4/1964 Zastera ..... A47C 23/18 5/233
3,237,212 A * 3/1966 Hillenbrand ..... A47C 20/041 5/616
3,284,126 A * 11/1966 Piazza ..... A61G 5/006 296/20
3,304,116 A * 2/1967 Stryker ..... A61G 7/00 296/20
3,318,596 A * 5/1967 Herzog ..... A61G 13/0009 5/619
3,419,922 A * 1/1969 Malherbe ..... A61G 7/0507 5/430
3,932,903 A * 1/1976 Adams ..... A61G 7/015 5/100
3,961,383 A * 6/1976 Spitz ..... A47C 19/005 5/181
4,178,645 A * 12/1979 Cosme ..... A47C 21/08 5/100
4,186,456 A * 2/1980 Huempfner ..... A61G 7/0507 297/411.34
4,225,988 A * 10/1980 Cary ..... A61G 7/015 5/607
4,554,692 A * 11/1985 Whitehead ..... A47C 19/025 248/916
4,559,656 A * 12/1985 Foster ..... A61G 7/0573 5/236.1
4,658,450 A * 4/1987 Thompson ..... A61G 7/008 5/607
4,669,136 A * 6/1987 Waters ..... A61G 7/00 177/144
4,685,159 A * 8/1987 Oetiker ..... A61G 7/002 5/608
4,747,171 A * 5/1988 Einsele ..... A61G 7/0509 5/425
4,858,260 A * 8/1989 Failor ..... A61G 5/006 5/618
5,038,430 A * 8/1991 Bly ..... A47C 21/08 403/397
5,090,071 A * 2/1992 Bathrick ..... A47C 19/122 5/174
5,125,122 A * 6/1992 Chen ..... A61G 7/015 5/607
5,303,437 A * 4/1994 Hung ..... A61G 7/015 5/607
5,377,370 A * 1/1995 Foster ..... A61G 7/002 5/185
5,423,097 A * 6/1995 Brule ..... A61G 7/015 403/324
5,454,126 A * 10/1995 Foster ..... A61G 7/00 5/600
5,468,216 A * 11/1995 Johnson ..... A61H 1/0292 5/616
5,479,665 A * 1/1996 Cassidy ..... A61G 7/001 5/609
5,502,853 A * 4/1996 Singleton ..... A47C 21/006 5/185
5,535,464 A * 7/1996 Salonica ..... A61G 7/015 5/604
5,537,701 A * 7/1996 Elliott ..... A47C 19/005 5/616
5,579,550 A * 12/1996 Bathrick ..... A47C 19/005 5/184
5,608,932 A * 3/1997 Hasegawa ..... A47C 20/041 5/600
5,699,566 A * 12/1997 Chuang ..... A61G 7/015 5/613
5,784,732 A * 7/1998 Vail ..... A47C 21/08 16/350
6,070,935 A * 6/2000 Heimann ..... A47C 20/041 297/354.13
6,073,286 A * 6/2000 Wu ..... A47C 19/122 5/616
6,357,065 B1 * 3/2002 Adams ..... A47C 19/04 5/611
6,360,386 B1 * 3/2002 Chuang ..... A61G 7/001 5/607
6,374,436 B1 * 4/2002 Foster ..... A61G 7/0015 5/624
6,374,437 B1 * 4/2002 Voelker ..... A61G 7/0507 5/425
6,393,641 B1 * 5/2002 Hensley ..... A47C 20/041 5/613
6,789,280 B1 * 9/2004 Paul ..... A61G 7/012 5/425
6,795,988 B2 * 9/2004 Hueppe ..... A61G 7/05 5/424
6,886,196 B2 * 5/2005 Nygren ..... A47C 21/08 5/426
6,907,625 B2 * 6/2005 Nomura ..... A61G 7/053 5/617
7,007,327 B2 * 3/2006 Ogawa ..... A61B 5/16 5/609
7,448,100 B1 * 11/2008 Shih ..... A61G 7/015 5/600
7,676,862 B2 * 3/2010 Poulos ..... A61G 7/005 5/424
7,743,441 B2 * 6/2010 Poulos ..... A61G 7/002 5/613
7,913,334 B2 * 3/2011 Guguin ..... A61G 7/0507 5/100
8,028,359 B2 * 10/2011 Parson ..... A61G 5/006 5/610
8,104,118 B2 * 1/2012 Derenne ..... A61G 7/0507 5/425
8,104,122 B2 * 1/2012 Richards ..... A61G 7/05 5/600
8,710,950 B2 * 4/2014 Lubbers ..... A61G 7/018 340/13.24
8,806,682 B2 * 8/2014 Hornbach ..... A61G 7/015 5/611
9,009,888 B1 * 4/2015 Tekulve ..... A61G 7/002 5/181
9,089,459 B2 * 7/2015 Dindas ..... A61G 1/0287
9,119,753 B2 * 9/2015 Poulos ..... A61G 7/0514

(56) References Cited

U.S. PATENT DOCUMENTS 9,226,590 B1 * 1/2016 Hull ..... F16B 12/56
9,265,677 B2 * 2/2016 Manouchehri ..... A61G 7/0507
9,622,927 B1 * 4/2017 Edgerton ..... A61G 7/002
9,724,254 B2 * 8/2017 Cole ..... A61G 7/001
10,028,873 B2 * 7/2018 Eskridge, III ..... A47C 20/041
10,413,463 B2 * 9/2019 Borges De Abreu ..... A61G 7/012
2002/0144350 A1 * 10/2002 Shih ..... A61G 7/015 5/620
2003/0024047 A1 * 2/2003 Wu ..... A61G 7/0507 5/430
2005/0028281 A1 * 2/2005 Ooyama ..... A61G 7/015 5/618
2005/0160530 A1 * 7/2005 Taguchi ..... A61G 7/015 5/618
2005/0166323 A1 * 8/2005 Kawakami ..... A61G 7/001 5/610
2006/0021144 A1 * 2/2006 Hornbach ..... A61G 7/0514 5/618
2006/0085913 A1 * 4/2006 Kawakami ..... A47C 20/041 5/618
2006/0117479 A1 * 6/2006 Kawakami ..... A61G 7/012 5/411
2007/0095618 A1 * 5/2007 Lai ..... A61G 5/0891 188/2 F
2008/0066232 A1 * 3/2008 Lin ..... A61G 7/0507 5/613
2008/0168602 A1 * 7/2008 DiForio ..... A47C 19/04 5/184
2009/0077744 A1 * 3/2009 Kim ..... A61G 7/053 5/202
2009/0077747 A1 * 3/2009 Kim ..... A61G 7/072 5/607
2009/0077748 A1 * 3/2009 Kim ..... A47C 20/08 5/613
2009/0293197 A1 * 12/2009 Larson ..... A47C 20/04 5/618
2012/0005828 A1 * 1/2012 McCullar ..... A47C 20/041 5/412
2012/0096645 A1 * 4/2012 Shih ..... A61G 7/015 5/614
2012/0137430 A1 * 6/2012 Geiger ..... A47C 19/02 5/201
2013/0019407 A1 * 1/2013 Sheppard ..... A47C 20/041 5/611
2013/0283531 A1 * 10/2013 Rawls-Meehan ..... A61G 7/018 5/619
2014/0189954 A1 * 7/2014 Lee ..... A61G 7/015 5/618
2015/0305954 A1 * 10/2015 Kuenzler ..... A61G 7/005 5/610
2016/0000624 A1 * 1/2016 Cho ..... A61G 7/015 5/619
2019/0021507 A1 * 1/2019 Shan ..... A47C 19/005

* cited by examiner

MODULAR BED

CROSS-REFERENCE TO RELATED APPLICATION

This application claims the benefit of priority under 35 U.S.C. § 119 to Taiwanese utility model patent application no. 107201605, filed on Feb. 1, 2018, which is herein incorporated by reference herein in its entirety.

FIELD

The disclosure relates to a modular bed, more particularly to a modular bed with cushioning effect.

BACKGROUND

Conventionally, it is a mattress that provides cushioning effect. A conventional bed base or modular bed for supporting the mattress is normally made from stiff material, and thus is less likely to provide such cushioning effect.

SUMMARY

Therefore, an object of the disclosure is to provide a modular bed with cushioning effect.

According to a first aspect of the disclosure, a modular bed includes a base frame unit, and a plurality of support frame units mounted on the base frame unit to be displaced from each other in a longitudinal direction, each of the support frame units includes a leading bar, a trailing bar, four mounting frames, four biasing members, a left linkages, and a right linkage. The leading and trailing bars are displaced from each other in the longitudinal direction. Each of the leading and trailing bars has a left end segment and a right end segment opposite to the left end segment in a transverse direction relative to the longitudinal direction. Each of the mounting frames is mounted on a respective one of the left and right end segments of the leading and trailing bars, and has a top abutment wall, a bottom abutment wall spaced apart from the top abutment wall in an upright direction, and two lateral walls which are spaced apart from each other in the longitudinal direction, and which define a cavity together with the top and bottom abutment walls. Each of the lateral walls has a pivot region, and a journal region that is formed with a pin hole and that is opposite to the pivot region in the transverse direction. Each of the biasing members is disposed in the cavity of a respective one of the mounting frames, and has a leaf spring and a pair of pins. The leaf spring has a base and two legs. The base has an upward edge, a downward edge, and two juncture regions opposite to each other. Each of the legs extends from a respective one of the juncture regions of the base in the transverse direction to terminate at a leg end. The pins extend respectively from the leg ends of the legs and away from each other to terminate at two pin ends, and are configured to extend respectively through the pin holes of the lateral walls of the respective mounting frame, so as to permit the pin ends to be disposed outwardly of the respective pin holes, respectively. Each of the left and right linkage is for interconnecting a respective pair of the mounting frames and includes a retaining member and a pair of levers. The retaining member extends in the longitudinal direction to terminate at two connected end segments. Each of the levers extends lengthwise from a respective one of the connected end segments to terminate at a coupled end segment which has two lugs disposed to flank the lateral walls of a respective one of the mounting frames.

Each of the lugs has a pivotal region pivotally mounted to a respective one of the pivot regions of the respective mounting frame about a fulcrum axis, and a weight region formed with an engaging slot which is configured to permit a respective one of the pin ends of the respective biasing member to be engageably received therein, and which, in response to loading or unloading on the retaining member, is brought into frictional engagement with the respective pin end at a first engaging end or a second engaging end to permit the upward edge or the downward edge of the base of the respective leaf spring to abut against the top abutment wall or the bottom abutment wall of the respective mounting frame so as to generate a counteracting force to counteract the loading or unloading movement of the retaining member, thereby providing a cushioning effect for the retaining member.

According to a second aspect of the disclosure, a modular bed includes a base frame unit, a plurality of support frame units, a plurality of support webs, and a drive unit. The support frame units are mounted on the base frame unit to be displaced from each other in a longitudinal direction. At least one of the support frame units is pivotally mounted to the base frame unit. Each of the support frame units includes a leading bar, a trailing bar, four mounting frames, four position limiting members, a left linkage, and a right linkage. The leading and trailing bars are displaced from each other in the longitudinal direction. Each of the leading and trailing bars has a left end segment and a right end segment opposite to the left end segment in a transverse direction relative to the longitudinal direction. Each of the mounting frames is mounted on a respective one of the left and right end segments of the leading and trailing bars. The position limiting members are respectively mounted to the mounting frames. Each of the position limiting members has a pin. Each of the left and right linkages is for interconnecting a respective pair of the mounting frames, and includes a retaining member and a pair of levers. The retaining member extends in the longitudinal direction to terminate at two connected end segments. Each of the levers extends lengthwise from a respective one of the connected end segments to terminate at a coupled end segment which is pivotally mounted to the respective mounting frame about a fulcrum axis, and which has an engaging slot that extends to terminate at a first engaging end and a second engaging end, and that is configured to permit the pin of the respective position limiting member to be engageably received therein and to be engageable with the first or second engaging end so as to limit angular movement of the retaining member in response to loading or unloading on the retaining member. Each of the support webs is configured to be stretchable between the retaining members of the left and right linkages of a respective one of the support frame units for providing a counteract force which counteracts the loading movement of the respective retaining members. The drive unit is coupled between the base frame unit and the at least one of the support frame units so as to permit one of the leading and trailing bars of the at least one of the support frame units to be driven to move to an elevated position, where the one of the leading and trailing bars is remote from the ground, from a normal position, where the one of the leading and trailing bars is close to the ground.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
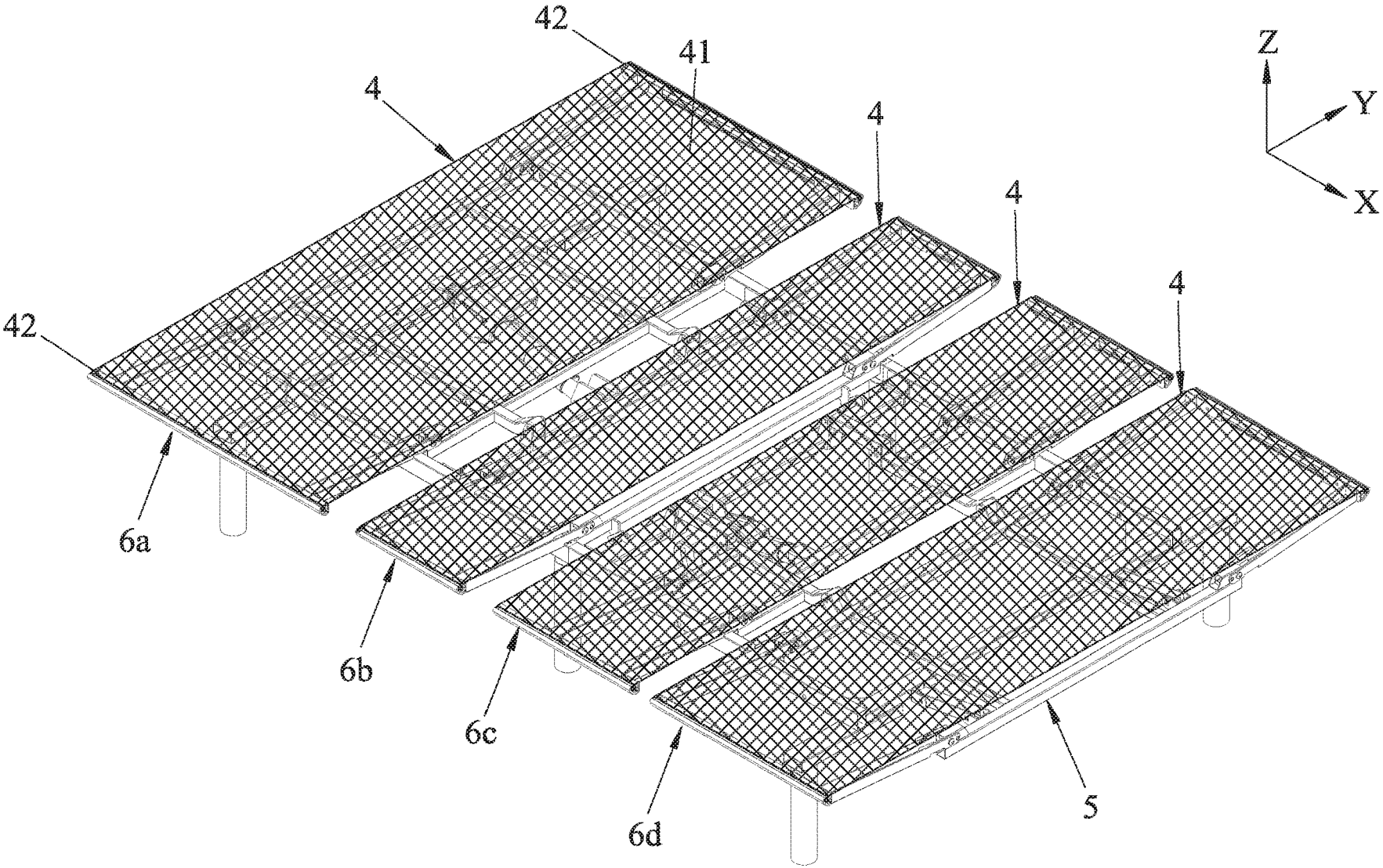
FIG. 1 is a perspective view of a modular bed according to an embodiment of the disclosure.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1 to 4, a modular bed is shown to include a base frame unit 5, and a plurality of support frame units 6*a*, 6*b*, 6*c*, 6*d* mounted on the base frame unit 5 to be displaced from each other in a longitudinal direction (X). Each of the support frame units 6*a*, 6*b*, 6*c*, 6*d* includes a leading bar 71, a trailing bar 72, four mounting frames 74, four biasing members 73, a left linkages 8*a*, and a right linkage 8*b*.

The leading and trailing bars 71, 72 are displaced from each other in the longitudinal direction (X). Each of the leading and trailing bars 71, 72 has a left end segment 701 and a right end segment 702 opposite to the left end segment 701 in a transverse direction (Y) relative to the longitudinal direction (X).

Figure 4:
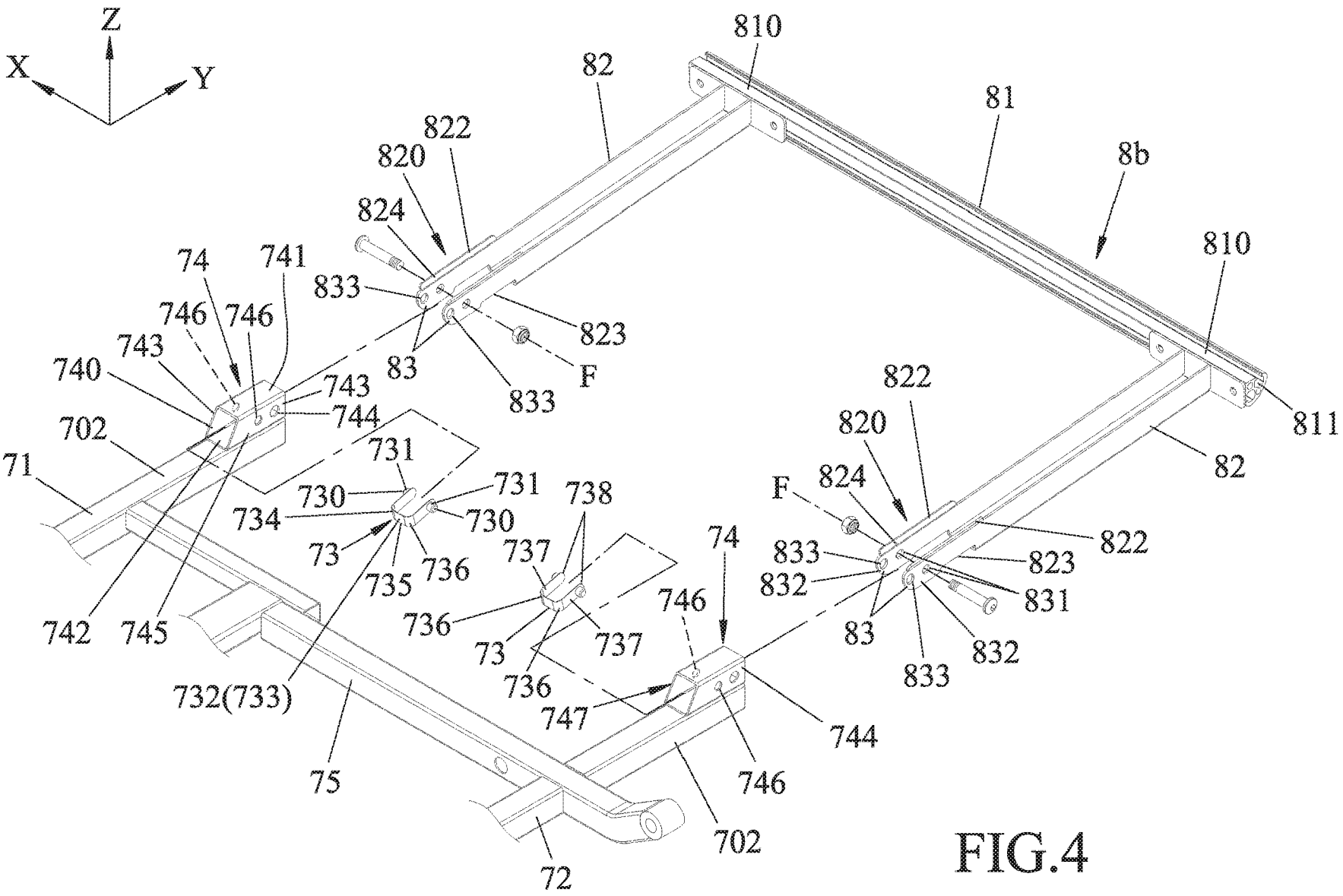
FIG. 4 is a fragmentary enlarged exploded perspective view of FIG. 3.
Figure 7:
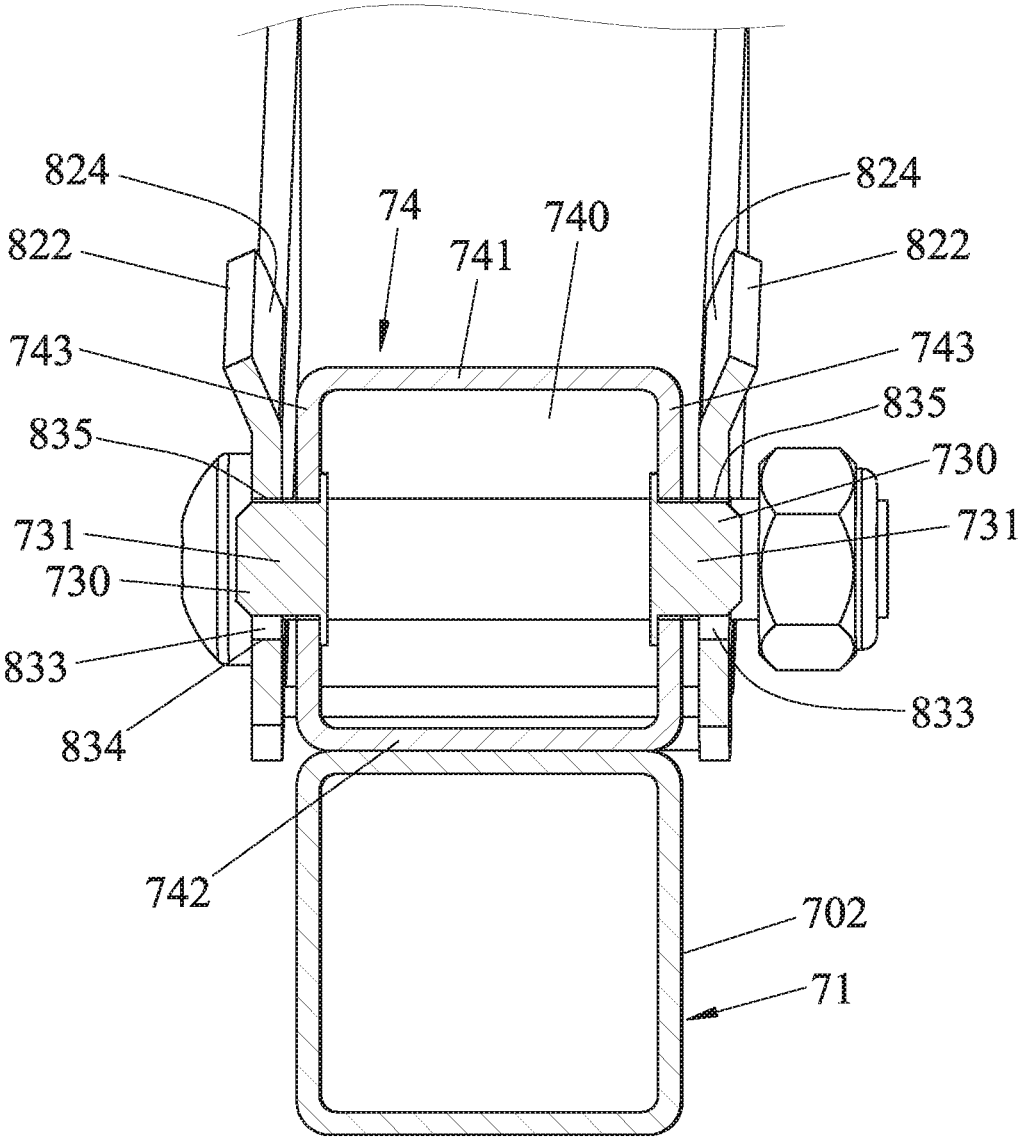
FIG. 7 is a cross-sectional view taken along line VII-VII of FIG. 3.

Each of the mounting frames 74 is mounted on a respective one of the left and right end segments 701, 702 of the leading and trailing bars 71, 72, and has a top abutment wall 741, a bottom abutment wall 742, and two lateral walls 743 (see FIGS. 4 and 7).

The bottom abutment wall 742 is spaced apart from the top abutment wall 741 in an upright direction (Z) to be secured on the respective one of the left and right end segments 701, 702. In other embodiment, the bottom abutment wall 742 may be integrally formed with the respective one of the left and right end segments 701, 702.

The lateral walls 743 are spaced apart from each other in the longitudinal direction (X), and define a cavity 740 together with the top and bottom abutment walls 741, 742. Each of the lateral walls 743 has a pivot region 744 and a journal region 745. The journal region 745 is formed with a pin hole 746 and is opposite to the pivot region 744 in the transverse direction.

Each of the biasing members 73 is a position limiting member, and is disposed in the cavity 740 of a respective one of the mounting frames 74, and has a pair of pins 731 and a leaf spring 732.

The leaf spring 732 has a base 733 and two legs 737. The base 733 has an upward edge 734, a downward edge 735, and two juncture regions 736 opposite to each other. Each of the legs 737 extends from a respective one of the juncture regions 736 of the base 733 in the transverse direction (Y) to terminate at a leg end 738. In an embodiment, the leaf spring 732 is made of metal.

Figure 6:
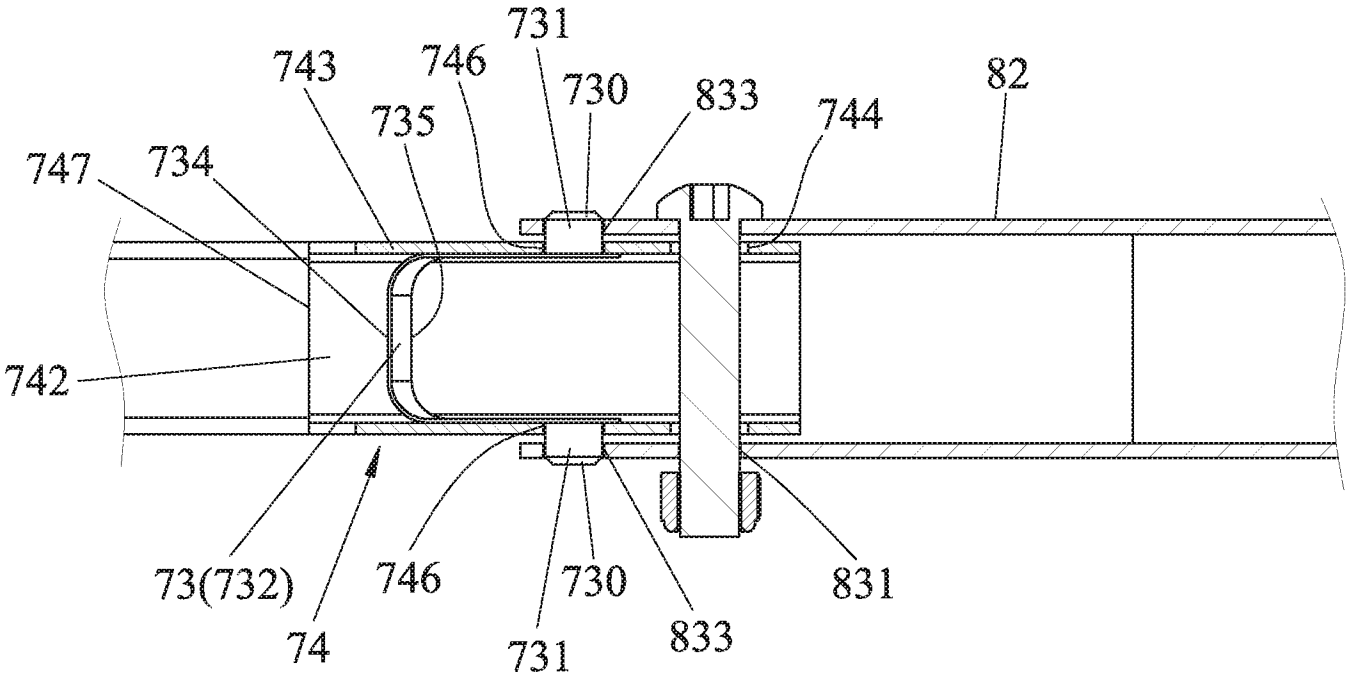
FIG. 6 is a cross-sectional view taken along line VI-VI of FIG. 3.

The pins 731 extend respectively from the leg ends 738 of the legs 737 and away from each other to terminate at two pin ends 730, and are configured to extend respectively through the pin holes 746 of the lateral walls 743 of the respective mounting frame 74, so as to permit the pin ends 730 to be disposed outwardly of the respective pin holes 746, respectively (see FIG. 6).

Each of the left and right linkages 8*a*, 8*b* is for interconnecting a respective pair of the mounting frames 74, and includes a retaining member 81 and a pair of levers 82.

As shown in FIG. 4, the retaining member 81 extends in the longitudinal direction (X) to terminate at two connected end segments 810.

Each of the levers 82 extends lengthwise from a respective one of the connected end segments 810 to terminate at a coupled end segment 820 which has two lugs 83. The two lugs 83 are disposed to flank the lateral walls 743 of a respective one of the mounting frames 74. Each of the lugs 83 has a pivotal region 831 and a weight region 832.

The pivotal region 831 is pivotally mounted to a respective one of the pivot regions 744 of the respective mounting frame 74 about a fulcrum axis (F). As such, the retaining member 81 is angularly displaceable about the fulcrum axis.

The weight region 832 is formed with an engaging slot 833 which has a first engaging end 834 and a second engaging end 835 (see FIGS. 5, 7, and 8), and which is configured to permit a respective one of the pin ends 730 of the respective biasing member 73 to be engageably received therein. In response to loading or unloading on the retaining member 81, the engaging slot 833 is brought into frictional engagement with the respective pin end 730 at the first engaging end 834 or the second engaging end 835 to permit the upward edge 734 or the downward edge 735 of the base 733 of the respective leaf spring 732 to abut against the top abutment wall 741 or the bottom abutment wall 742 of the respective mounting frame 74 so as to generate a counteracting force to counteract the loading or unloading movement of the retaining member 81, thereby providing a cushioning effect for the retaining member 81.

Figure 8:
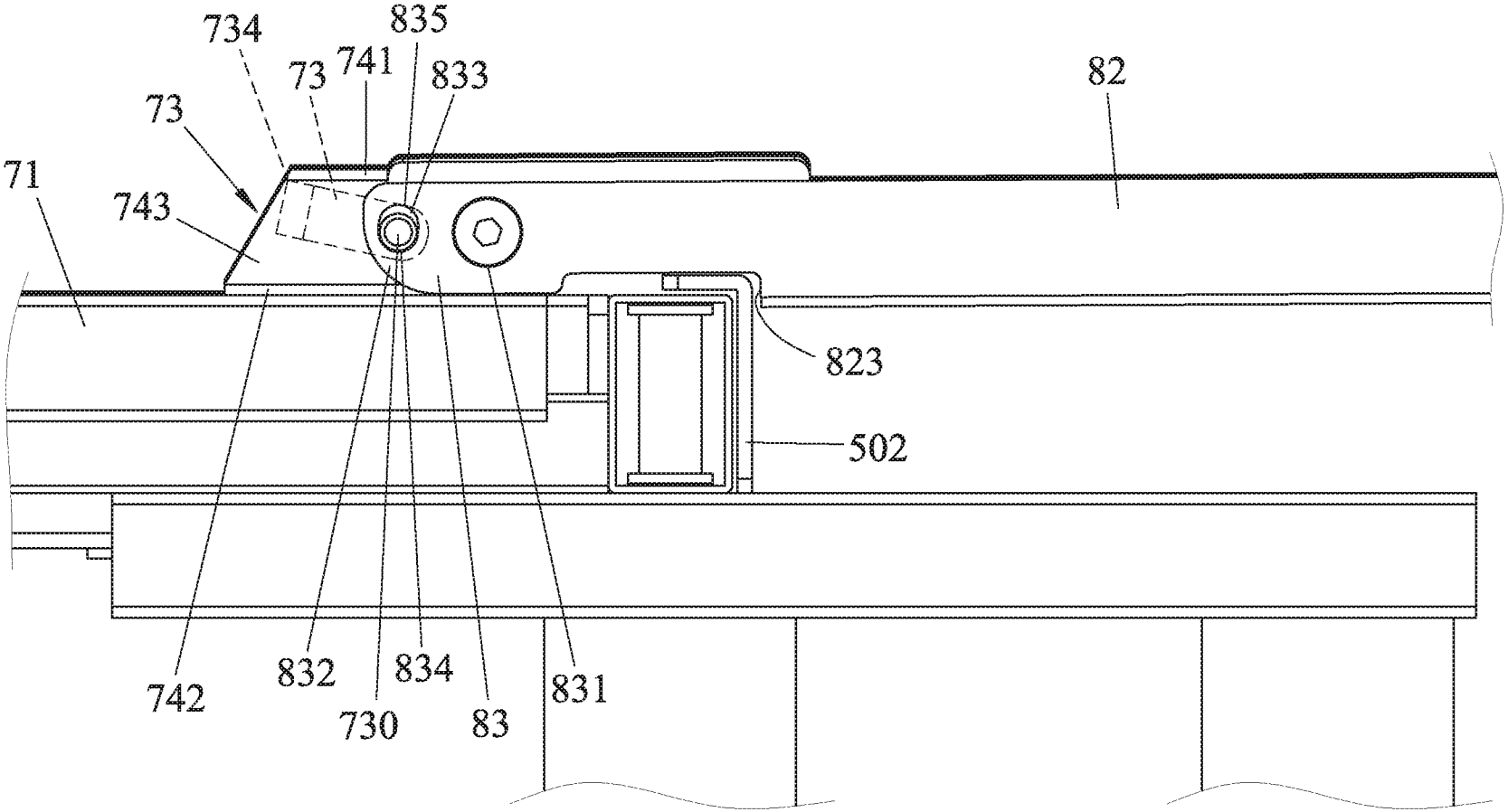
FIG. 8 is similar to FIG. 5 but illustrating a state when the retaining member is loaded.
Figure 15:
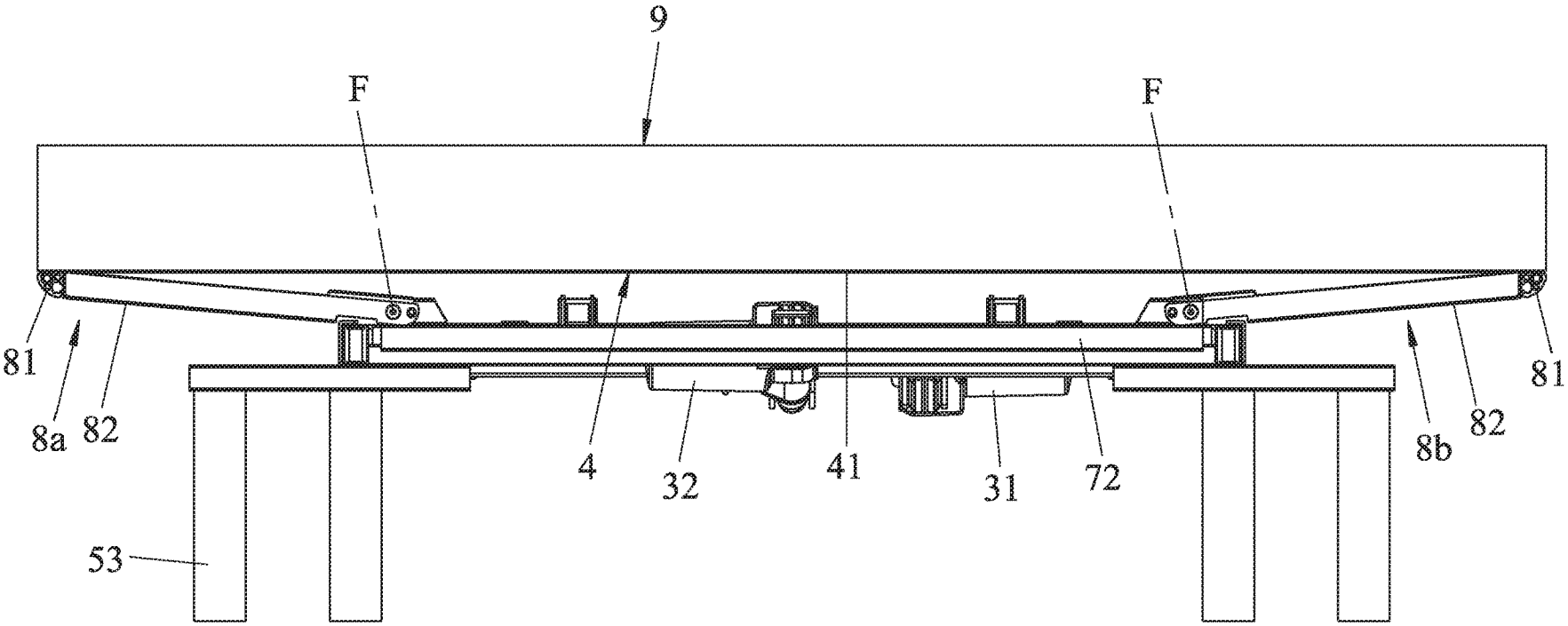
FIG. 15 is a side view of the modular bed illustrating when retaining members are unloaded.
Figure 16:
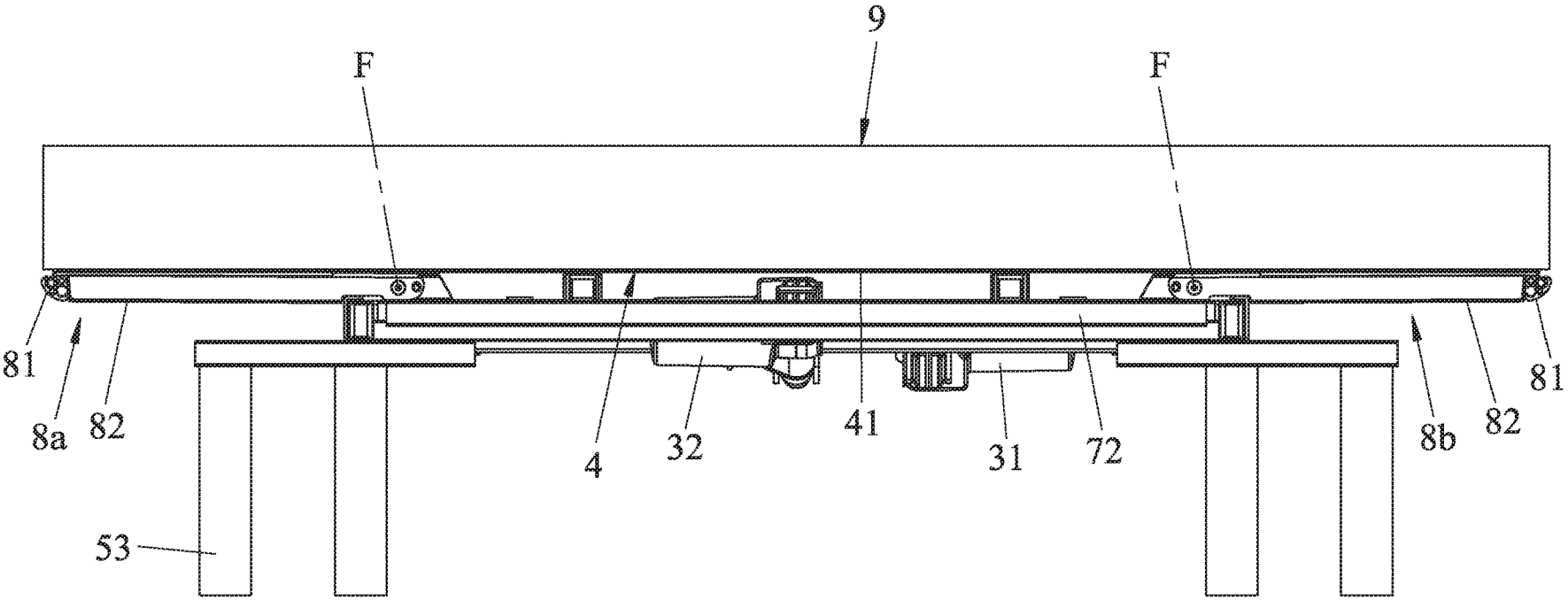
FIG. 16 is similar to FIG. 15 but illustrating when the retaining members are loaded.

To be specific, in response to the loading movement of the retaining member 81, as shown in FIGS. 8 and 16, the first engaging end 834 is brought into frictional engagement with the respective pin end 730, and the respective upward edge 734 is permitted to abut against the respective top abutment wall 741 for counteracting the loading movement. In response to the unloading movement of the retaining member 81, as shown in FIGS. 5-7 and 15, the second engaging end 835 is brought into frictional engagement with the respective pin end 730, and the respective downward edge 735 is permitted to abut against the respective bottom abutment wall 742 for counteracting the unloading movement of the retaining member 81.

Each of the retaining member 81 and the levers 82 may be made of a lightweight, high strength metal piece.

Figure 5:
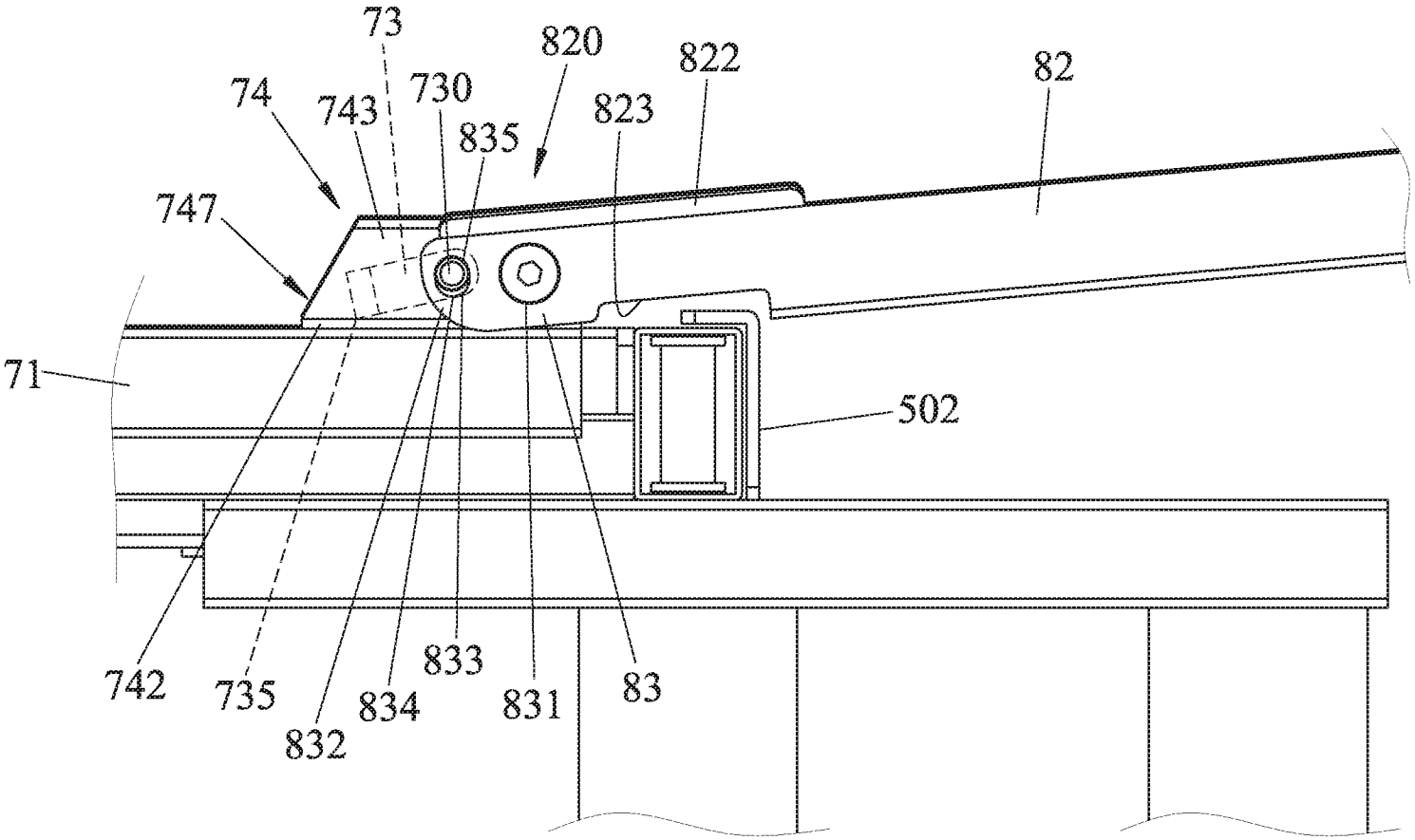
FIG. 5 is a fragmentary enlarged side view of the modular bed illustrating a state when a retaining member is unloaded.

In an embodiment shown in FIGS. 4-6, each of the mounting frames 74 has an access opening 747 configured to permit the respective biasing member 73 to access the cavity 740. The lateral walls 743 are spaced apart from each other in the longitudinal direction (X) by a distance which is slightly smaller than a distance defined between the legs 737 of the leaf spring 732 to permit the legs 737, by virtue of manual pressing the legs 737 toward each other against a biasing force of the leaf spring 732, to be insertable through the respective access opening 747 and to permit the pin ends 730 to move toward the respective pin holes 746 such that once the pins 731 are respectively brought into register with the respective pin holes 746, the pin ends 730 are urged by the biasing force to extend outwardly of the respective pin holes 746, respectively.

In an embodiment, the top and bottom abutment walls 741, 742 define therebetween a predetermined height such that angular displacement of the respective retaining member 81 about the fulcrum axis (F) due to the loading or unloading is less than 10 degree. In other embodiments, the angular displacement of the respective retaining member 81 about the fulcrum axis (F) due to the loading or unloading may be less than 7 or 5 degree.

Figure 9:
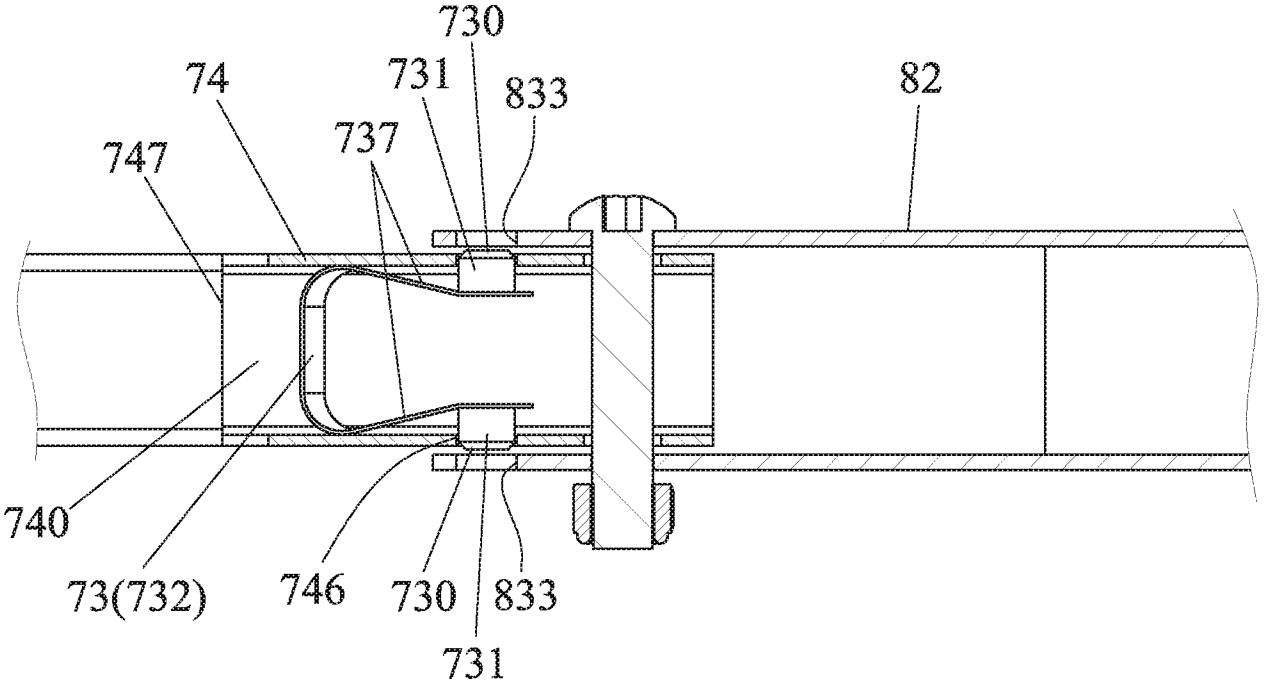
FIG. 9 is similar to FIG. 6 but illustrating pin ends of a biasing member in a retracted position.
Figure 10:
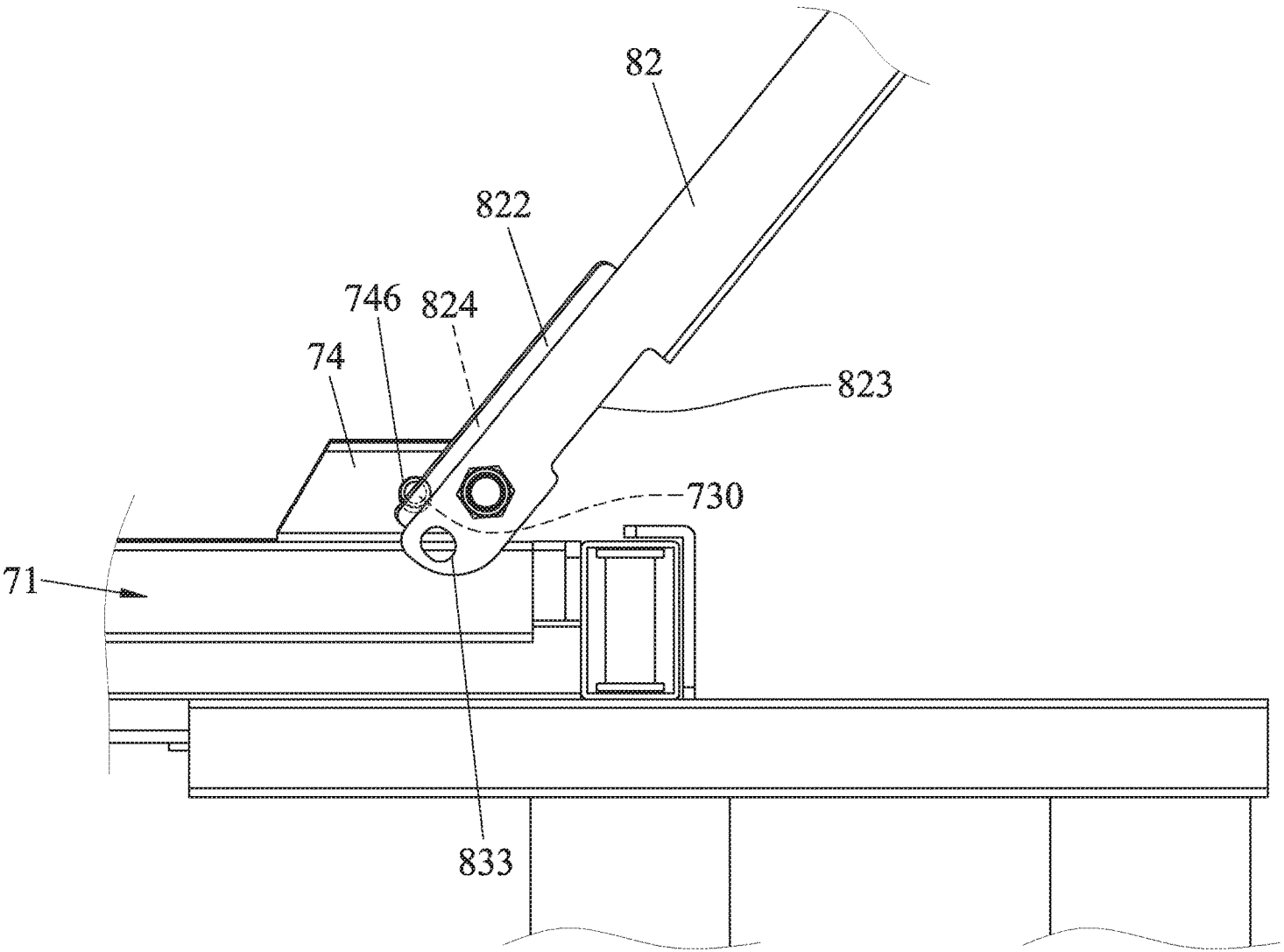
FIG. 10 is similar to FIG. 5 but illustrating a state when rotation of the retaining member is not limited by the pin ends.
Figure 11:
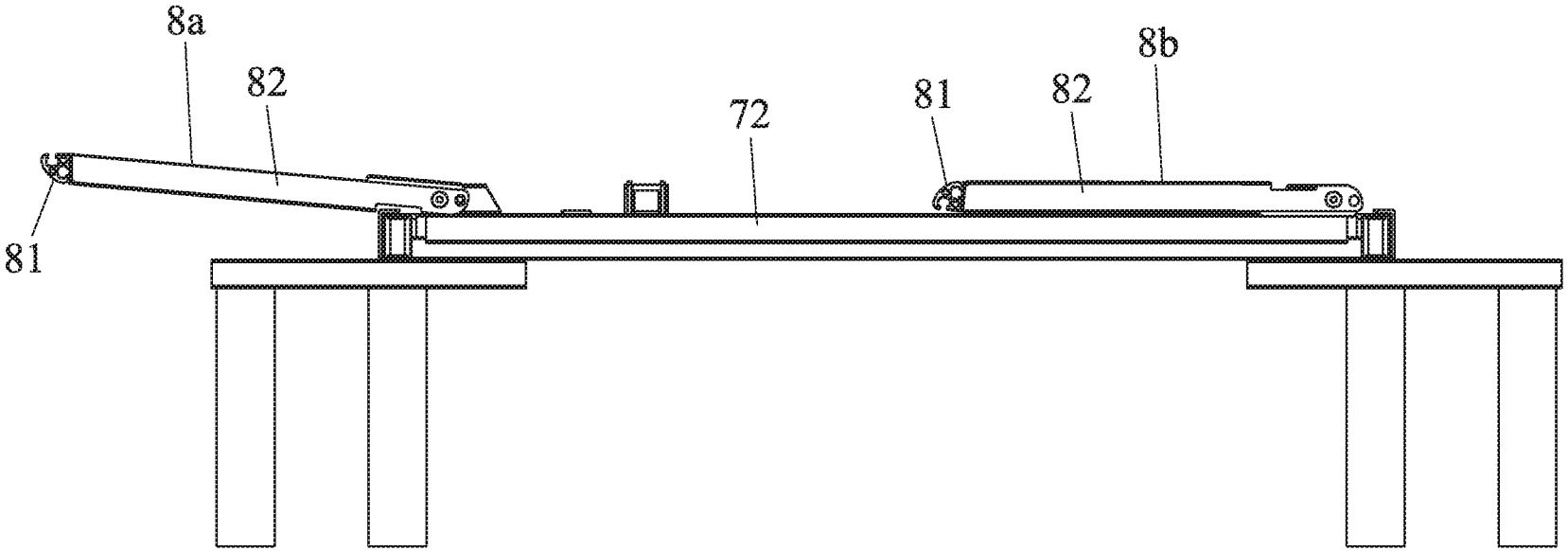
FIG. 11 is a side view of the modular bed illustrating levers of a right linkage in a fully folded position.

In an embodiment shown in FIGS. 4, 6, and 7, each of the left and right linkages 8*a*, 8*b* further includes at least one cam piece 822 with a cam surface 824. The cam piece 822 is disposed on one of the lugs 83 and angularly displaced from the respective pin hole 833 about the fulcrum axis (F). As shown in FIG. 9, subsequent to manual inward movement of the respective pin end 730 to a retracted position, where the respective pin end 730 is disengaged from the respective engaging slot 833 for enabling angular movement of the respective weight region in a counterclockwise direction (FIG. 10), the cam surface 824 is brought into engagement with the respective pin end 730 so as to keep the respective pin end 730 in the retracted position, thereby allowing rotation of the respective weight region 832 by 180 degree and displacing the respective lever 82 in a fully folded position (FIG. 11).

In an embodiment shown in FIGS. 4, 6, and 7, each of the left and right linkages 8*a*, 8*b* includes eight of the cam pieces 822.

Figure 2:
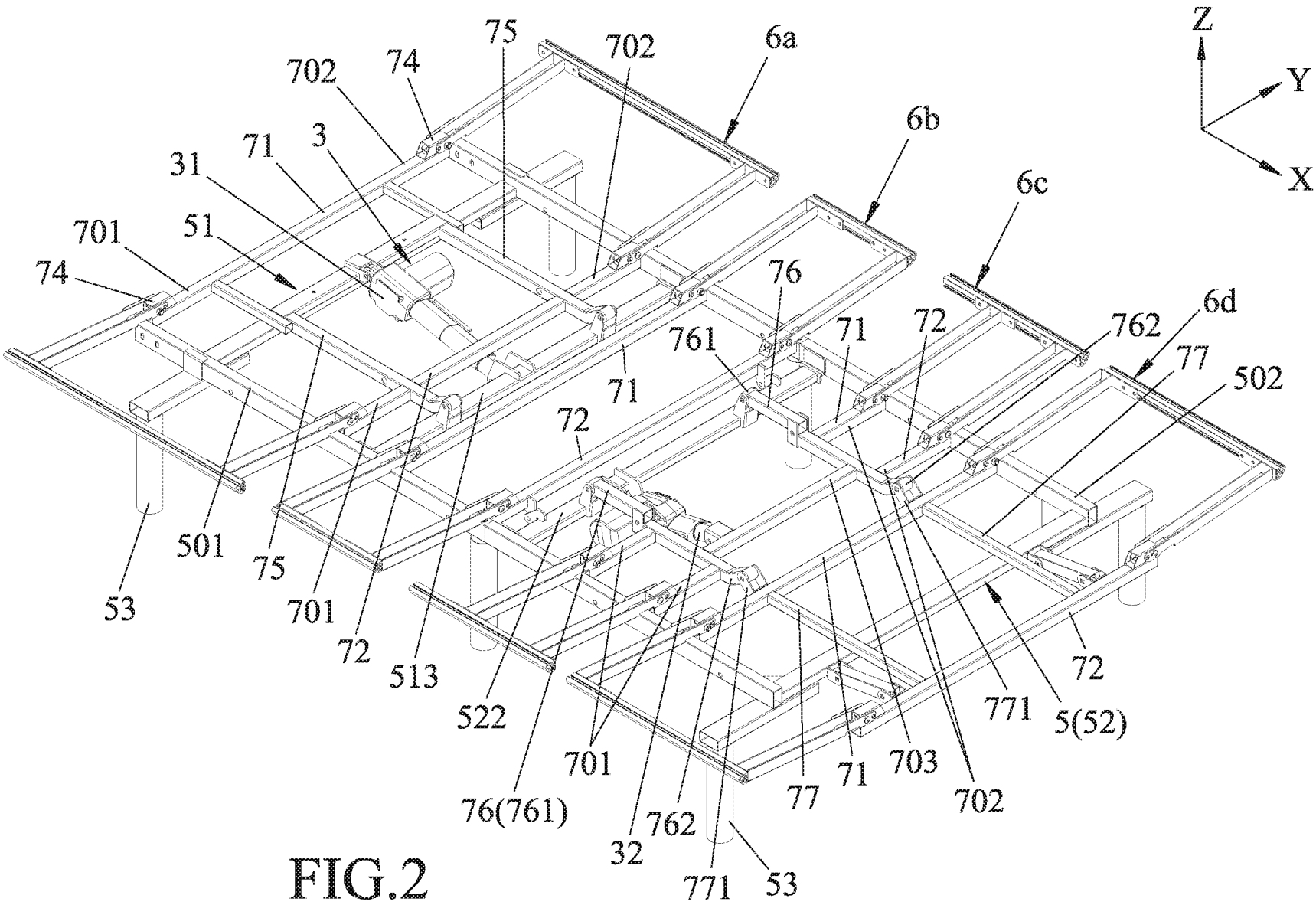
FIG. 2 is similar to FIG. 1 but supporting webs are omitted.

In an embodiment shown in FIGS. 1 and 2, the modular bed further includes a plurality of support webs 4 each of which is configured to be stretchable on a respective one of the support frame units 6*a*, 6*b*, 6*c*, 6*d*, and each of which includes a web body 41 and two lateral portions 42. The lateral portions 42 are at opposite sides of the web body 41, and are respectively coupled to the retaining members 81 of the left and right linkages 8*a*, 8*b* of the respective support frame unit 6*a*, 6*b*, 6*c* or 6*d* such that when the retaining members 81 are loaded (FIG. 16), the web body 41 is permitted to be fully stretched therebetween. As shown in FIGS. 15 and 16, the support webs 4 may cooperatively support a mattress 9. Each of the support webs 4 also provides a counteracting force to counteract the loading movement of the retaining members 81 of the respective support frame unit 6*a*, 6*b*, 6*c* or 6*d*.

When the pin end 730 is in the retracted position (FIG. 9), the respective retaining member 81 is angularly movable about the fulcrum axis (F) among a non-stretching position (FIG. 14), a partial stretching position (FIG. 15), and a fully stretching position (FIG. 16).

Figure 13:
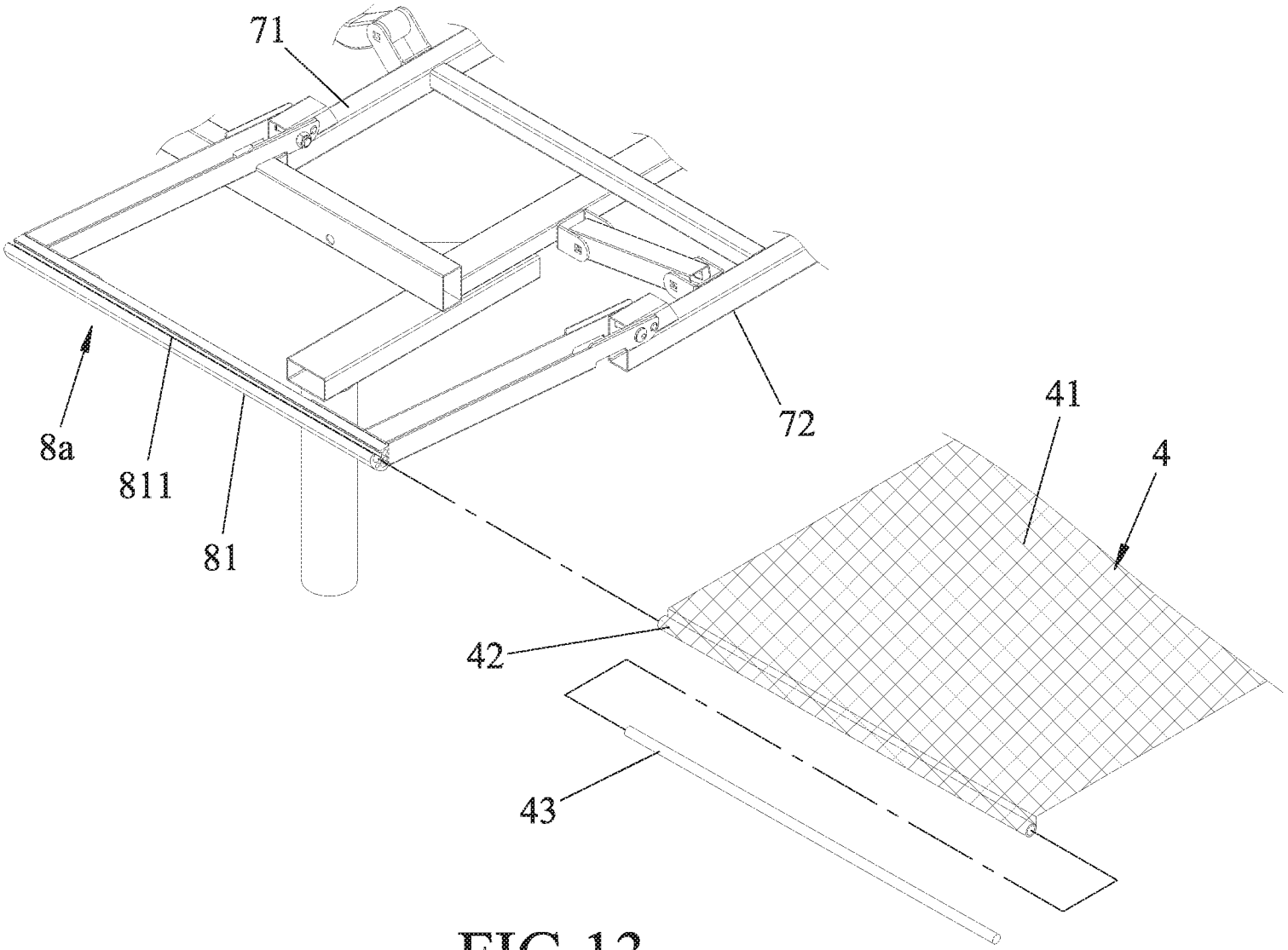
FIG. 13 is a fragmentary exploded enlarged view illustrating how a lateral portion of a web body in the modular bed is led into an elongated retaining groove of a retaining member.
Figure 14:
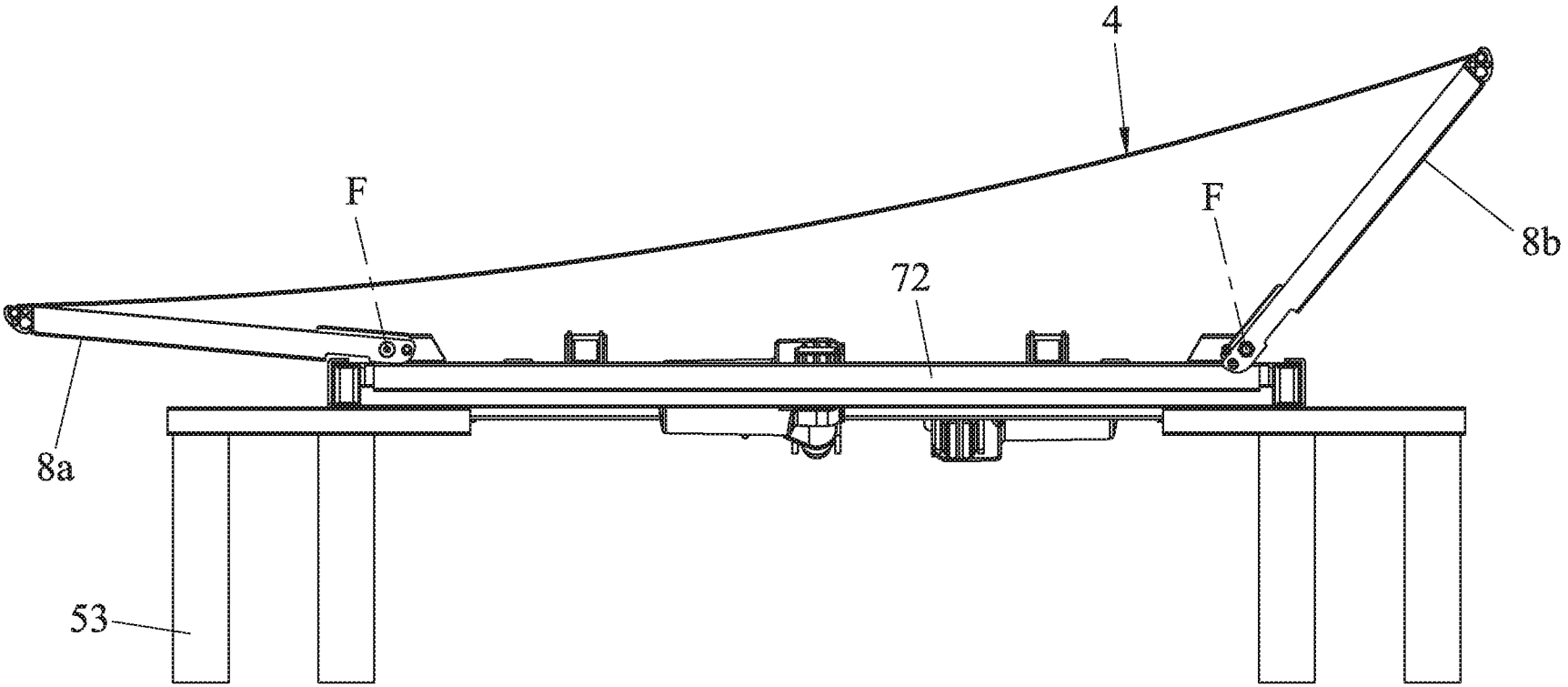
FIG. 14 is a side view of the modular bed illustrating the web body is not stretched.

Each of the retaining members 81 has an elongated retaining groove 811 (see FIGS. 4 and 13). Each of the lateral portions 42 is enlarged compared to the web body 41, and is in the form of a tubular sleeve. Each of the support frame units 6*a*, 6*b*, 6*c*, 6*d* further includes two reinforced rods 43 (only one is shown in FIG. 13). Each of the reinforced rods 43 is configured to be inserted into the respective tubular sleeve 42 to ensure the respective tubular sleeve 42 be retained in the respective elongated retaining groove 811 when the retaining members 81 is displaced to the partial or fully stretching position (FIG. 15 or 16) from the non-stretching positions (FIG. 14).

In an embodiment, the base frame unit 5 includes a left rail 501 and a right rail 502 which are spaced apart in the transverse direction (Y).

In addition, as shown in FIG. 4, each of the levers 82 includes a groove rider 823 which is disposed adjacent to the coupled end segment 820, and which is configured to be mate with a respective one of the left and right rails 501, 502 so as to help maintain the web body 41 in a fully stretched position (FIGS. 8 and 16).

Figure 3:
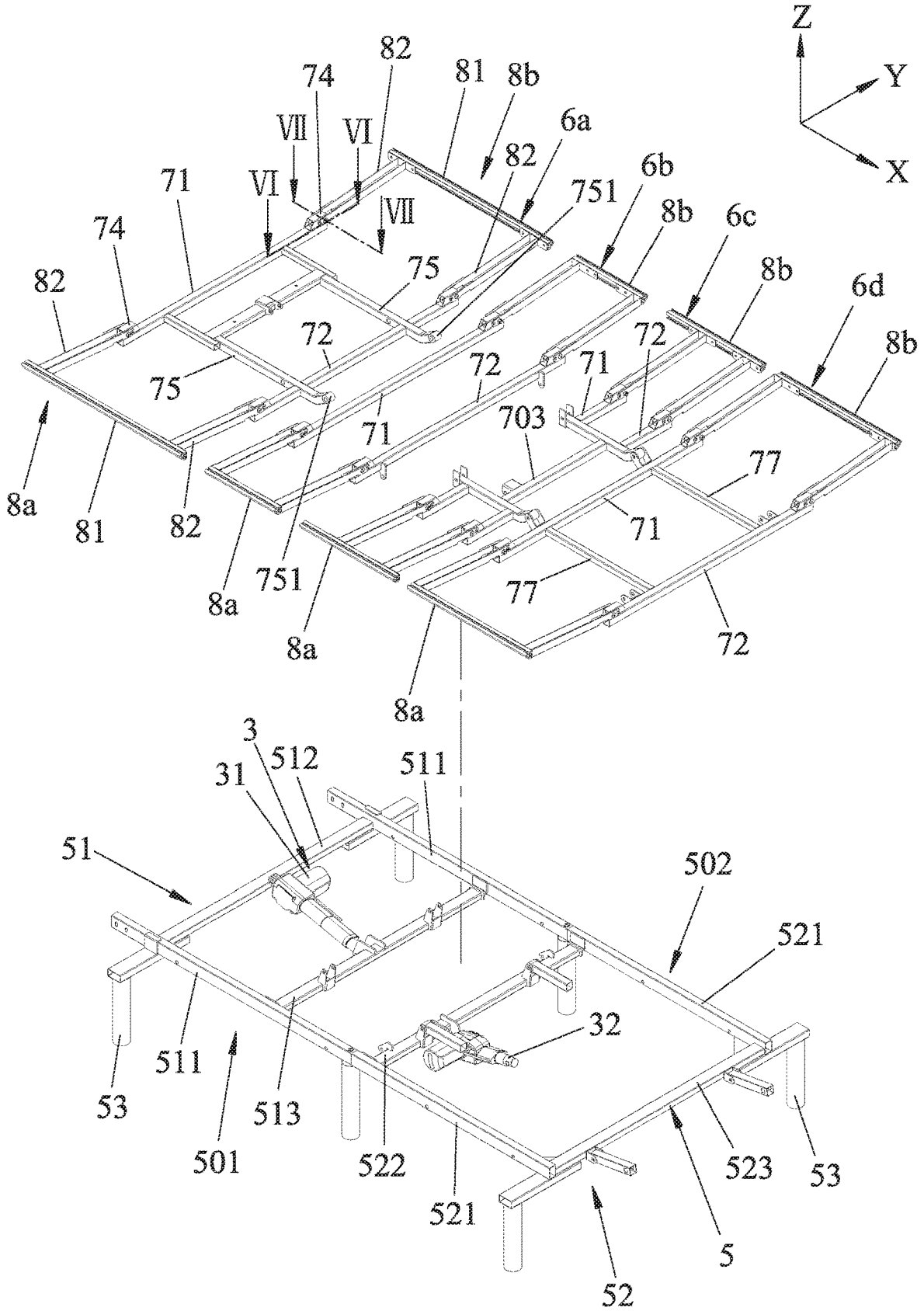
FIG. 3 is an exploded perspective view of FIG. 2.

In an embodiment shown in FIGS. 2 and 3, the modular bed further includes a plurality of support legs 53 are configured to elevate and place the base frame unit 5 in a stationary state. The support legs 53 may be detachably mounted to the base frame unit 5.

In an embodiment shown in FIGS. 2 and 3, the base frame unit 5 has a front base frame 51 and a rear base frame 52. The rear base frame 52 is coupled to and aligned with the front base frame 51 in the longitudinal direction (X) to permit the front and rear base frames 51, 52 to be arranged in a head-to-tail arrangement.

The front base frame 51 includes two front beams 511, a first front transverse beam 512, and a second front transverse beam 513, and the rear base frame 52 includes two rear beams 521, a first rear transverse beam 522, and a second rear transverse beam 523. Each of the front beams 511, the first and second front transverse beams 512, 513, the rear beams 521, and the first and second rear transverse beams 522, 523 may be a square, hollow metal tube which is of lightweight and high strength. The elements for the base frame unit 5 may be easily assembled or disassembled.

In this embodiment, two left ones of the front and rear beams 511, 521 constitute the left rail 501, and two right ones of the front and rear beams 511, 521 constitute the right rail 502.

In an embodiment shown in FIGS. 2 and 3, the modular bed includes four of the support frame units 6*a*, 6*b*, 6*c*, 6*d*. A first one of the support frame units is a first front support frame unit 6*a*, a second one of the support frame units is a second front support frame unit 6*b*, a third one of the support frame units is a first rear support frame unit 6*c*, and a fourth one of the support frame units is a second rear support frame unit 6*d*.

As shown in FIGS. 2 and 3, the first front support frame unit 6*a* is mounted on the front base frame 51, and further includes a pair of head support links 75 each extending from the leading bar 71 through the trailing bar 72 to terminate at a pivot end 751 which is mounted pivotally on the second front transverse beam 513 so as to permit leading bar 71 of the first front support unit 6*a* to be lifted from a head normal position (FIG. 2), where the leading bar 71 is close to the ground, to a head elevated position (FIG. 12), where the leading bar 71 is remote from the ground.

The second front support frame unit 6*b* is mounted on the front base frame 51, and is disposed rearwardly of the first front support frame unit 6*a*. In addition, the leading and trailing bars 71, 72 of the second front support frame unit 6*b* are secured on the front beams 511.

The first rear support frame unit 6*c* is mounted on the rear base frame 52, and further includes a pair of front leg links 76 and a middle bar 703 (see FIG. 2). The middle bar 703 interconnects the front leg links 76 for connecting the left and right end segments 701, 702 of each of the leading and trailing bars 71, 72. Each of the front leg links 76 has a first forward pivot end segment 761 and a first rearward pivot end 762. The first forward pivot end segment 761 is mounted pivotally on the first rear transverse beam 522 so as to permit the middle bar 703 to be lifted from a leg normal position (FIG. 2) where the middle bar 703 is close to the ground, to a leg elevated position (FIG. 12), where the middle bar 703 is remote from the ground.

The second rear support frame unit 6*d* is mounted on the rear base frame 52, and is disposed rearwardly of the first rear support frame unit 6*c*. The second rear support frame unit 6*d* further includes a pair of rear leg support links 77 each extending from the trailing bar 72 through the leading bar 71 to terminate at a second forward pivot end 771. The second forward pivot end 771 is pivotally connected to the first rearward pivot end 762 of a respective one of the front leg links 76 so as to permit the leading bar 71 of the second rear support frame unit 6*d* to be lifted when the middle bar 703 is lifted to the leg elevated position.

Each of the bars, the links, and the mounting frames of the support frame units 6*a*, 6*b*, 6*c*, 6*d* may be a square, hollow metal tube of lightweight and high strength, or may be constituted by a plurality of square, hollow metal tube segments of lightweight and high strength. The elements for the support frame units 6*a*, 6*b*, 6*c*, 6*d* may be easily assembled or disassembled.

Figure 12:
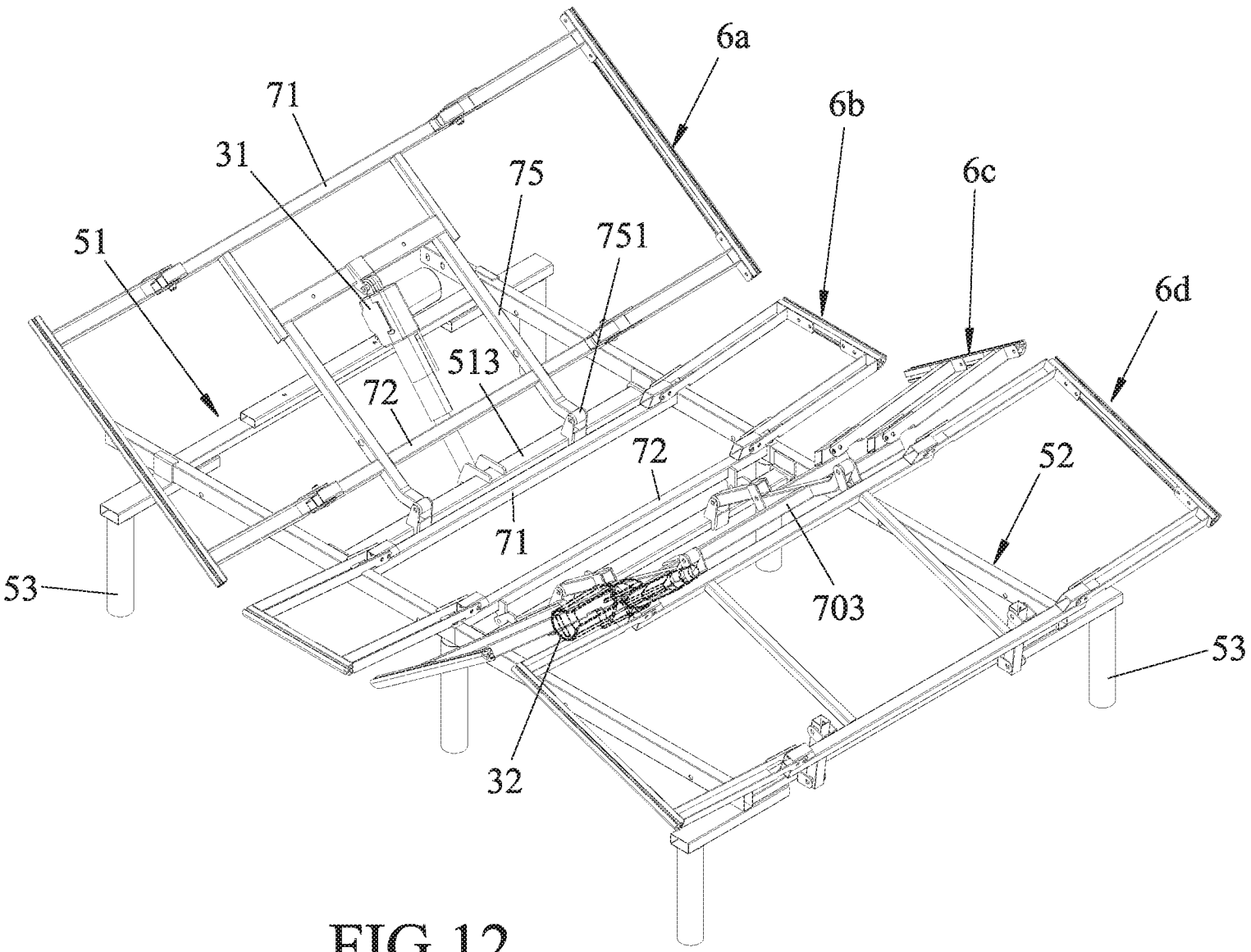
FIG. 12 is similar to FIG. 2 but illustrating the modular bed in another state.

In an embodiment shown in FIGS. 2, 3, and 12, the modular bed further includes a drive unit 3 which includes a front jack member 31 and a rear jack member 32. The front and rear jack members 31, 32 can be operated independently.

The front jack member 31 is coupled between the front base frame 51 and the first front support frame unit 6*a* so as to permit the leading bar 71 of the first front support frame unit 6*a* to be driven by the front jack member 31 to move between the head normal position and the head elevated position.

The rear jack member 32 is coupled between the rear base frame 52 and the first rear support frame unit 6*c* so as to permit the middle bar 703 of the first rear support frame unit 6*c* to be driven by the rear jack member 32 to move between the leg normal position and the leg elevated position.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A modular bed comprising a base frame unit, and a plurality of support frame units mounted on said base frame unit to be displaced from each other in a longitudinal direction, each of said support frame units including a leading bar and a trailing bar which are displaced from each other in the longitudinal direction, each of said leading and trailing bars having a left end segment and a right end segment opposite to said left end segment in a transverse direction relative to the longitudinal direction, four mounting frames each of which is mounted on a respective one of said left and right end segments of said leading and trailing bars, and each of which has a top abutment wall, a bottom abutment wall spaced apart from said top abutment wall in an upright direction, and two lateral walls which are spaced apart from each other in the longitudinal direction, and which define a cavity together with said top and bottom abutment walls, each of said lateral walls having a pivot region, and a journal region that is formed with a pin hole and that is opposite to said pivot region in the transverse direction, four biasing members each of which is disposed in said cavity of a respective one of said mounting frames, and each of which has a leaf spring having a base having an upward edge, a downward edge, and two juncture regions opposite to each other, and two legs each of which extends from a respective one of said juncture regions of said base in the transverse direction to terminate at a leg end, and a pair of pins which extend respectively from said leg ends of said legs and away from each other to terminate at two pin ends, and which are configured to extend respectively through said pin holes of said lateral walls of said respective mounting frame, so as to permit said pin ends to be disposed outwardly of said respective pin holes, respectively, and a left linkage and a right linkage, each for interconnecting a respective pair of said mounting frames, each of said left and right linkages including a retaining member extending in the longitudinal direction to terminate at two connected end segments, and a pair of levers each extending lengthwise from a respective one of said connected end segments to terminate at a coupled end segment which has two lugs disposed to flank said lateral walls of a respective one of said mounting frames, each of said lugs having a pivotal region pivotally mounted to a respective one of said pivot regions of said respective mounting frame about a fulcrum axis, and a weight region formed with an engaging slot which is configured to permit a respective one of said pin ends of said respective biasing member to be engageably received therein, and which, in response to loading or unloading on said retaining member, is brought into frictional engagement with said respective pin end at a first engaging end or a second engaging end to permit said upward edge or said downward edge of said base of said respective leaf spring to abut against said top abutment wall or said bottom abutment wall of said respective mounting frame so as to generate a counteracting force to counteract the loading or unloading movement of said retaining member, thereby providing a cushioning effect for said retaining member.

2. The modular bed according to claim 1, further comprising a plurality of support webs each of which is configured to be stretchable on a respective one of said support frame units, and each of which includes a web body, and two lateral portions which are at opposite sides of said web body, and which are respectively coupled to said retaining members of said left and right linkages of said respective support frame unit such that when said retaining members are loaded, said web body is permitted to be fully stretched therebetween.

3. The modular bed according to claim 2, wherein said base frame unit includes a left rail and a right rail which are spaced apart in the transverse direction, and each of said levers includes a groove rider which is disposed adjacent to said coupled end segment, and which is configure to be mated with a respective one of said left and right rails so as to help maintain said web body in a fully stretched position.

4. The modular bed according to claim 1, wherein each of said mounting frames has an access opening configured to permit said respective biasing member to access said cavity, and said lateral walls are spaced apart from each other in the longitudinal direction by a distance which is slightly smaller than a distance defined between said legs of said leaf spring to permit said legs, by virtue of manual pressing said legs toward each other against a biasing force of said leaf spring, to be insertable through said respective access opening and to permit said pin ends to move toward said respective pin holes such that once said pins are respectively brought into register with said respective pin holes, said pin ends are urged by the biasing force to extend outwardly of said respective pin holes, respectively.

5. The modular bed according to claim 1, wherein said top and bottom abutment walls define therebetween a predetermined height such that angular displacement of said respective retaining member about the fulcrum axis due to the loading or unloading is less than 10 degree.

6. The modular bed according to claim 1, wherein each of said left and right linkages further includes at least one cam piece which has a cam surface and which is disposed on one of said lugs and angularly displaced from said respective pin hole about the fulcrum axis such that subsequent to manual inward movement of said respective pin end to a retracted position, where said respective pin end is disengaged from said respective engaging slot for enabling angular movement of said respective weight region in a counterclockwise direction, said cam surface is brought into engagement with said respective pin end so as to keep said respective pin end in said retracted position, thereby allowing rotation of said respective weight region by 180 degree and displacing said respective lever in a fully folded position.

* * * * *